United States Patent [19]

Leiker

[11] 4,266,908

[45] May 12, 1981

[54] EXCAVATING APPARATUS

[76] Inventor: Donald G. Leiker, 1512 N. 13th St., Garden City, Kans. 67846

[21] Appl. No.: 50,636

[22] Filed: Jun. 21, 1979

[51] Int. Cl.[3] ..... E02F 3/46

[52] U.S. Cl. ..... 414/690; 212/230; 414/718; 414/722; 414/728

[58] Field of Search ..... 414/687, 689–692, 414/694, 703, 715, 718, 722, 727, 728; 212/230, 231, 267; 37/103

[56] References Cited

U.S. PATENT DOCUMENTS

| | | | |
|---|---|---|---|
| 1,438,752 | 12/1922 | Doering | 414/692 |
| 2,334,323 | 11/1943 | Gilbert | 414/690 X |
| 2,348,796 | 5/1944 | Ferwerda | 414/690 X |
| 2,674,500 | 4/1954 | Hukari . | |
| 2,792,138 | 5/1957 | Olson . | |
| 2,852,149 | 9/1958 | Bruneri . | |
| 3,550,795 | 12/1970 | Schofield . | |
| 3,575,307 | 4/1971 | Guinot . | |
| 3,680,724 | 8/1972 | Schaeff . | |
| 3,703,973 | 11/1922 | Nilsson . | |
| 3,999,670 | 12/1976 | Weyhausen . | |

FOREIGN PATENT DOCUMENTS

| | | | |
|---|---|---|---|
| 640860 | 5/1962 | Canada | 414/690 |
| 1369919 | 7/1964 | France | 414/690 |

*Primary Examiner*—Leslie J. Paperner
*Assistant Examiner*—Terrance L. Siemens
*Attorney, Agent, or Firm*—Fishburn, Gold and Litman

[57] ABSTRACT

An apparatus for excavating or cleaning out sumps and drainage pits includes a mobile, towable chassis rotatably supporting a platform thereon. A standard extends upwardly from the platform and an elongate, rigid boom structure and guide is mounted upon the standard for upward and downward swinging movement and for forward and rearward reciprocal movement relative to the platform. A material engaging member such as a bucket is mounted to a forward end of the boom structure and has a cover therewith whereby the bucket closes and traps mud or loose materials for removal from the sump or drainage pit. An engine mounted upon the platform powers a hydraulic pump for routing fluid under pressure to motors and rams controlling operation of the platform, boom structure and material engaging member. An operator's seat and console is mounted on the platform and has controls therewith for directing operation of the apparatus whereby the platform is rotatable to position the boom structure and the engaging member generally over an area and material to be excavated, the boom structure is swingable downwardly for contact of the engaging member with the material and the boom structure is movable longitudinally rearwardly to remove the material.

4 Claims, 8 Drawing Figures

Fig. 3.
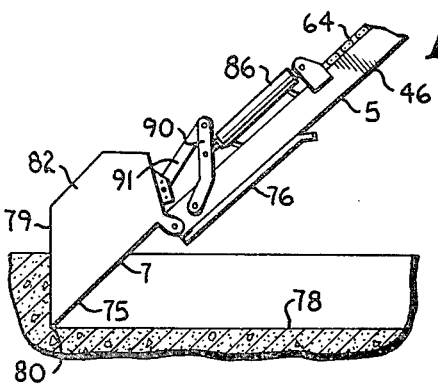
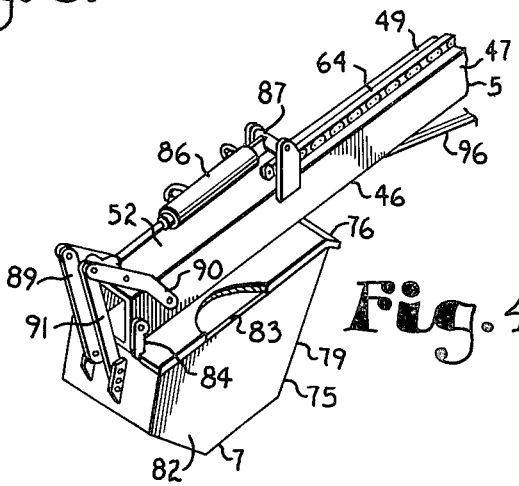
Fig. 4.
Fig. 5.
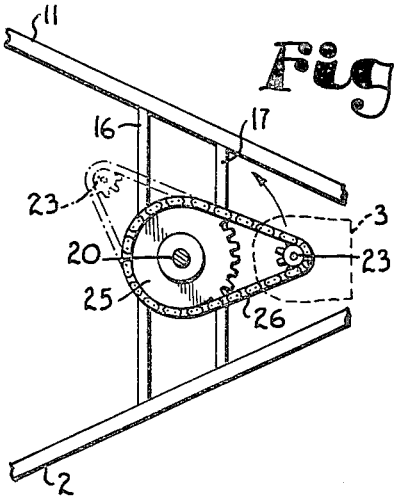
Fig. 6.
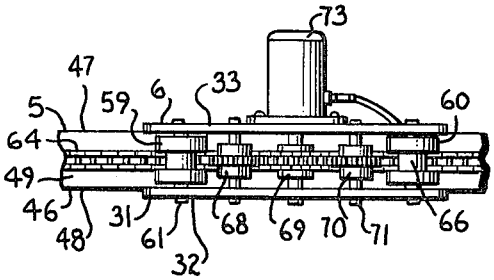
Fig. 7.
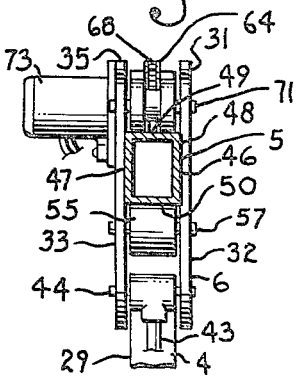
Fig. 8.
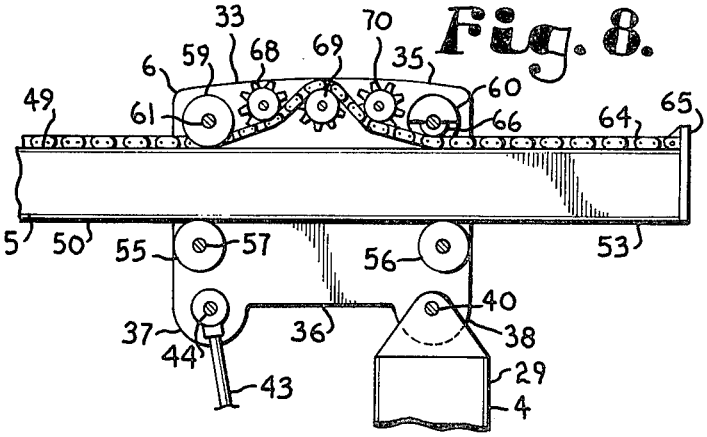

EXCAVATING APPARATUS

This invention relates to excavating apparatuses and particularly to such apparatuses adapted for excavating silt, mud or refuse material from sumps, drainage pits and the like.

Drainage pits or sumps are often installed for receiving runoff water from car washes, industrial cleaning racks, drains and the like. Water used for washing often carries great amounts of silt or mud into pipes which empty into sumps or drainage pits whereby the dirt settles from the water and the water passes on into suitable drainage systems. Car washes usually have a washing position or path along which the vehicles travel and with the floor formed to provide a drainage and collecting trough located longitudinally of the wash path. The trough receives silt or dirt laden water and acts as a settling tank, drainage pit or sump in which the silt, mud or refuse material is deposited and from which water runs off through a drain or other suitable disposal means.

The sumps or drainage pits often become quickly filled and may become clogged with silt or mud. Cleaning the sumps or pits is generally considered an undesirable job because the task requires substantial amount of time and effort and conditions are often unpleasant.

In view of the above, the principal objects of the present invention are: to provide an excavating apparatus which is mobile for ready transportation from site to site and adapted for excavating or cleaning out sumps, drainage pits and the like; to provide such an apparatus having a frame with a platform mounted thereon which can rotate a full 360°; to provide such an apparatus with a support pivoted on said platform for up and down movement and with an extensible boom and bucket thereon adapted for coordinated use to excavate or clean out sumps or drainage pits; to provide such an apparatus having a material engaging bucket generally sized for receipt into an elongate, deep, trough or drainage pit; to provide such an apparatus having a forwardly and rearwardly movable reciprocal boom structure for excavating material from the sump or pit; and to provide such an apparatus which is relatively inexpensive, highly reliable in use and well adapted for its intended purpose.

Other objects and advantages of this invention will become apparent from the following description taken in connection with the accompanying drawings wherein are set forth by way of illustration and example, a certain embodiment of this invention.

FIG. 3 is a detailed, fragmentary view of a material engaging member connected to a forward end of a boom structure and positioned within a sump or drainage pit for cleaning same.

FIG. 4 is an enlarged, fragmentary view of the material engaging member and a forward end of the boom structure.

FIG. 5 is a sectional view taken along lines 5—5, FIG. 1 and showing connecting members of the apparatus.

FIG. 6 is an enlarged, fragmentary top view showing the connection between the boom structure and a guide means therefor.

FIG. 7 is an enlarged, fragmentary end view showing details of the boom structure and the guide means.

FIG. 8 is an enlarged, fragmentary side view showing details of the boom structure and the guide means.

As required, a detailed embodiment of the present invention is disclosed herein, however, it is to be understood that the disclosed embodiment is merely exemplary of the invention which may be embodied in various forms. Therefore, specific functional and structural details disclosed herein are not to be intepreted as limiting, but merely as a basis for claims and as a representative basis for teaching one skilled in the art to variously employ the present invention in virtually any appropriately detailed structure.

Figure 1:
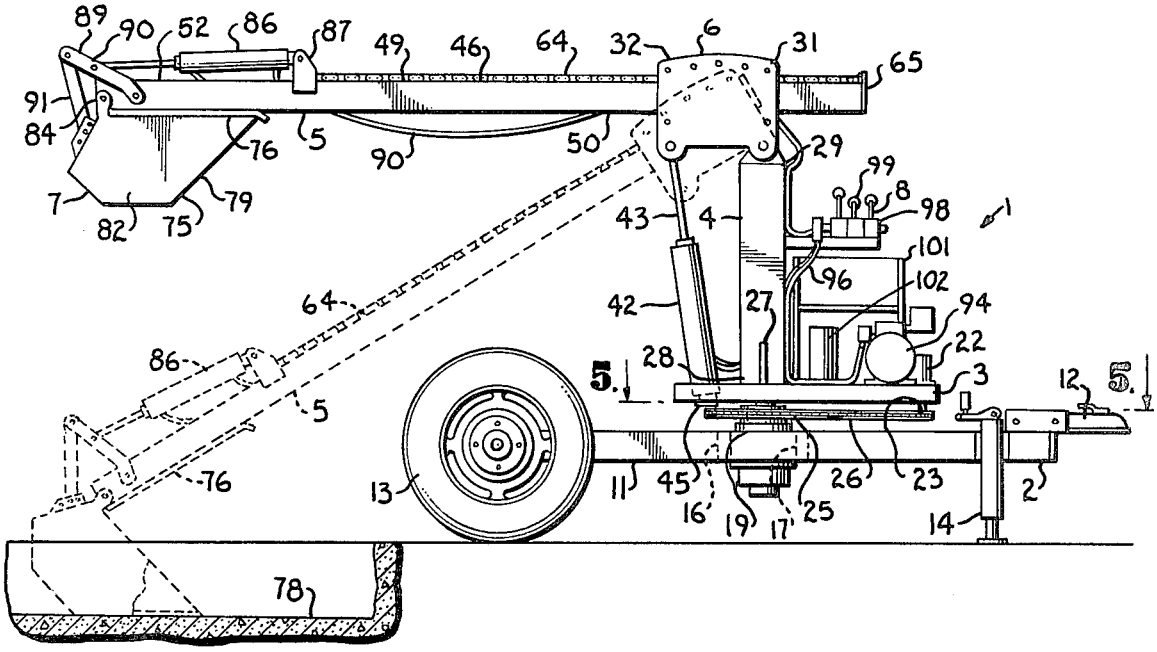
FIG. 1 is a side elevational view illustrating an excavating apparatus embodying this invention and in operation to clean out a sump or drainage pit.
Figure 2:
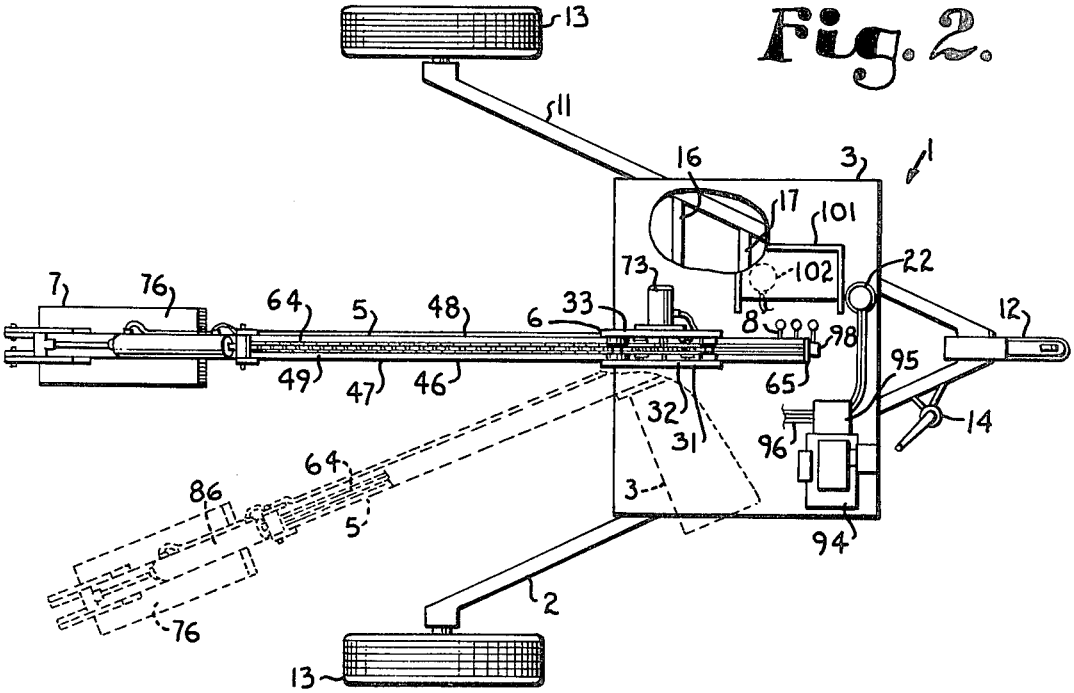
FIG. 2 is a top plan view of the excavating apparatus.

Referring more in detail to the drawings:

The reference numeral 1, FIGS. 1 and 2, generally indicates an excavating apparatus embodying the present invention and comprising a mobile chassis 2 supporting a platform 3 and having means rotatably mounting the platform 3 to the chassis 2. A standard 4 extends upwardly from the platform 3 and an elongate, rigid boom structure 5 is mounted to the standard 4 and supported by guide means 6 for upwardly and downward swinging movement and forward and rearward reciprocal movement relative to the platform 3. A material engaging member 7 is mounted to the boom structure 5 for excavating operations and a plurality of motive means are operable to effect rotation of the platform and movement of the boom structure. Control means 8 are included for controlling operation of the platform 3, boom structure 5 and material engaging member 7 whereby the platform is rotatable to position the boom structure and the material engaging member generally over material, the boom structure is swingable downwardly for contact of the material engaging member with the material and the boom structure is movable substantially longitudinally rearwardly to remove the material.

The mobile chassis 2 of the excavating apparatus 1 may be self-powered, part of a truck bed arrangement or the like and in the illustrated example is specifically adapted for towing by a vehicle and has generally triangularly arranged frame members 11 having converging front portions connected to a hitch 12 for connection to suitable towing arrangements on a moving vehicle such as a truck. Divergent and mutually spaced rear ends of the frame members 11 have wheels 13 rotatably mounted thereon for transport of the chassis 2. A front mounted jackstand arrangement 14 is suitably positioned for bearing the weight of a front of the excavating apparatus when disconnected from the towing vehicle.

The exemplary chassis 2 has spaced cross frame members 16 and 17 which extend between the frame members 11 and are suitably connected thereto as by welding or the like. Means rotatably connect the platform 3 in overlying relation to the chassis 2 and in the illustrated example, spaced upper and lower shaft holders or journal members 19 are suitably mounted between midportions of the respective cross frame members 16 and 17. A shaft 20 extends between the platform 3 and the chassis 2 and has a top end suitably affixed to the platform 3 and a bottom end rotatably received in the journal members 19 for relative rotation of the platform and the chassis. Drive means selectively effect rotation of the platform 3 relative to the chassis 2 and in the illustrated example the drive means comprises a hydraulic motor 22 affixed to the top surface of the platform 3 and having an axial shaft extending through the platform 3 and driving a first sprocket 23 which is positioned below the platform 3. A second and larger diameter sprocket 25 is nonrotatably secured relative to the chassis 2, as to the upper journal member 19, and the first sprocket 23 and second sprocket 25 are connected by an endless chain member 26. The platform 3 is rotatably mounted to the chassis 2 and because the second sprocket 25 is nonrotatably secured to the chassis 2, rotation of the first sprocket 23, as by the motor 22, causes the first sprocket 23 to in effect pull itself around the second sprocket 25 and thereby cause rotation of the platform 3 relative to the chassis 2 as shown in FIG. 5.

In the illustrated example, the standard 4 is rigidly mounted to the platform 3 and positioned so that it is substantially coaxial with the shaft 20 whereby the boom structure 5 rotates around a central axis of point. A lower end 28 of the standard 4 is suitably secured to the platform 3 as by welding or the like and abutted by a brace member 27. An upper free end portion 29 of the standard 4 is spaced above the platform 3 a sufficient distance to permit up and down swinging movement of the boom structure 5.

A guide means 6 pivotally mounts the boom structure 5 to the upper end portion 29 of the standard 4 for up and down swinging movement and in the illustrated example, the guide means 6 is a bracket member 31 having spaced side walls 32 and 33, FIGS. 6, 7 and 8. The side walls 32 and 33 respectively have upper and lower edges 35 and 36, the lower edge 36 having front and rear ear portions 37 and 38 extending downwardly therefrom. A plurality of pin members, described below, extend between and connect the side walls 32 and 33 and in the illustrated example, the upper end portion 29 of the standard 4 extends between the side walls 32 and 33 and is pivotally connected to respective rear ear portions 38 as by a pin 40. Means for effecting up and down swinging movement of the bracket member 31 in the illustrated example extend between the bracket member and the platform 3 and include a hydraulic ram 42 having a piston portion 43 with a free end positioned between the front ear portions 37 of the side walls 32 and 33 and pivotally secured thereto as by a pin 44. An opposite end of the ram 42 extends through an aperture in the platform 3 adjacent the standard 4 and is pivotally connected for forward and rearward swinging movmeent to a hangar member 45 mounted to the platform 3.

The exemplary boom structure 5 includes an elongate, rigid beam member 46 having opposite side walls 47 and 48 and top and bottom walls 49 and 50. The beam member 46 has a working or front end portion 52 and a rear end portion 53 and extends through the bracket member 31 between the side walls 32 and 33. Suitable support means are mounted within the bracket member 31 and in the illustrated example, FIGS. 6, 7 and 8 include lower roller members 55 and 56 extending between and connected to the side walls 32 and 33 as by pins 57 for rotatably engaging the beam member bottom wall 50. Positioned generally adjacent to and above the lower roller members 55 and 56 are upper roller members 59 and 60 extending between and connected to the side walls 32 and 33 as by respective pins 61 for rotatably engaging the beam member top wall 49. The upper roller members 59 and 60 are spaced from the underlying lower roller members 55 and 56 substantially the difference between beam member top and bottom 49 and 50 whereby the beam member 46 is rotatably supported within the bracket member 31 for forward and rearward longitudinal reciprocal movement therethrough.

Motive means are operable to effect the reciprocal movement of the boom structure 5 through the bracket member 31 and, in the illustrated example, the motive means includes a chain member 64 extended along the beam member top wall 49 and has one end connected to a plate member 65 affixed to the end margin of the beam member 46 which, when the beam member 46 is fully extended forwardly, contacts the roller member 60 and provides a stop for limiting forward movement of the beam member. The chain member 64 is connected at a forward end to the beam member front end portion 52. To accomodate the chain member 64, the upper roller members 59 and 60 have recessed slots or central portions 66 whereby the roller members 59 and 60 straddle the chain member 64 as the beam member 46 reciprocates thereunder. An exemplary series of three spaced sprockets 68, 69 and 70 extend between and are connected to the side walls 32 and 33 as by respective pins 71. The middle sprocket 69 is rotatably driven by a hydraulic motor 73 mounted to the side wall 33 and in the illustrated example, the chain member 64 is routed under two end sprockets 68 and 70 and over a middle sprocket 69 for affording ample engagement of the chain member 64 and the middle sprocket 69 whereby powered rotation of the sprocket 69 causes the chain member 64 to move thereover in the direction of rotation of the sprocket.

A material engaging member is suitably mounted to the boom structure 5 for gathering and receiving material to be excavated or cleaned out of a sump or drainage pit. In the illustrated example, the material engaging member includes a bucket member 75 swingably mounted to the beam member front end portion 52 and a bucket cover member 76 mounted to the beam member bottom wall 50 adjacent the front end portion 52 whereby the bucket member 75 is swingable to close against the bucket cover member 76 and trap material therein for removal from the sump or drainage pit. Preferably, the bucket member 75 is adapted for cleaning a relatively long, narrow trough of, for example 10 to 12 inches wide, such as the sump or drainage pit 78 shown in FIG. 1 and has a generally planar bottom portion 79 for sliding on a bottom floor of the sump or drainage pit 78 and a lip portion 80 which may be positioned as shown in FIG. 3 to slide down a vertical end wall of the sump or drainage pit 78 and clean material therefrom. The bucket member 75 has opposed side walls 82 which are spaced apart such as 10 to 12 inches to generally accord with the width dimension of the sump or drainage pit 78 whereby a single pass of the bucket member 75 over a portion of the sump or drainage pit 78 is generally sufficient to scoop silt and mud material therefrom.

The bucket member 75 has an open top portion 83 and spaced hinge ears 84 are pivotally connected to the front end portion 52 of the beam member 46 for swinging movement. When the bucket member 75 is swung rearwardly or toward the platform 3, material may be scooped therein. When swung completely rearwardly, the bucket member open top portion 83 engages the bucket cover member 76 to close same and retain the materials therein.

Motive means extend between the boom structure 5 and the material engaging member 7 to effect said swinging movement and in the illustrated example, a ram 86 has a cylinder end pivotally connected to a hangar structure 87 mounted to the front end portion 52 and a piston free end pivotally connected to a linkage arm arrangement 89 having pivotally connected link arms 90 and 91 controlling swinging movement of the bucket member 75.

Control means 8 control rotation of the platform 3, movement of the boom structure 5 and operation of the material engaging member 7. In the illustrated example, the control means 8 includes therewith an engine 94 mounted on the platform 3 and driving a hydraulic pump 95. An operator's console 98 extends from the standard 4 and includes suitable control valves and handle levers 99 for routing fluid under pressure from pressure fluid delivery conduits 96 to the hydraulic motor 22 for rotating the platform 3, the ram 42 for swinging the boom structure 5 upwardly and downwardly, the hydraulic motor 73 for moving the boom structure 5 forwardly and rearwardly and the ram 86 for opening and closing the bucket member 75. An operator's area or seat 101 is situated adjacent the console 98 and mounted on the platform 3 for rotation therewith. A hydraulic fluid reservoir 102 is mounted beneath the operator's area or seat 101 to provide a holding tank for hydraulic fluid.

In use, the apparatus 1 is positioned so that the wheels 13 generally straddle a sump or drainage pit 78 and the engine 94 is started. The operator sits on the operator's area or seat 101 and operates the appropriate control valves and handle levers 99 to route fluid under pressure to the motor 22 and rotate the platform 3 relative to the chassis 2 and position the boom structure 5 and the material engaging member 7 generally over the sump or drainage pit 78. Appropriate control valves and handle levers 99 are then operated to extend or swing the bucket member 75 outwardly and open same to receive silt, debris, or mud material therein. Appropriate control valves and handle levers 99 are operated to route fluid to the hydraulic motor 73 to extend the boom structure 5 generally over the sump or drainage pit 78 whereby the lip portion 80 of the bucket member 75 contacts a vertical wall portion of the sump or drainage pit. Using the control valves and handle levers 99 in coordination, the operator lowers the boom structure 5, swings the bucket member 75 rearwardly or toward the platform 3 to scrape the planar bottom portion 79 along the bottom of the sump or drainage pit 78 and retracts the boom structure 5 to draw the bucket member 75 generally longitudinally toward the platform 3 and scoop material therein. When the bucket member 75 is filled, the operator operates the appropriate control valve and handle levers 99 to lift and swing the boom structure 5 to a side and dump the load of silt, debris or mud material into a suitable container such as a truck body which can then be moved to a suitable disposal or dumping site.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. An excavating apparatus comprising:

(a) a mobile chassis for towing by a vehicle and having frame members with wheels rotatably mounted thereto for transport;

(b) a platform positioned in overlying, supported relation to said chassis and having an axial member extending between and connected to said platform and said chassis frame members providing relative horizontal rotation of said platform;

(c) drive means effecting rotation of said platform relative to said chassis including a hydraulic motor driving a first sprocket connected to a second sprocket nonrotatably mounted to said chassis via an endless drive chain member;

(d) an upwardly extending standard mounted to said platform and having a free end spaced from said platform;

(e) a guide means pivotally mounted to said standard free end for up and down swinging movement and having spaced side walls with roller members extending therebetween;

(f) an elongate, rigid boom structure mounted for forward and rearward longitudinal reciprocal movement to said guide means and having respective forward and rearward ends and top and bottom walls, said boom structure extending through said guide means between said side walls and supported therein by said roller members, said boom structure having a drive chain member connected thereto and generally extending between said forward and rearward ends along said top wall, said guide means having a hydraulic motor mounted to one of said side walls and driving a sprocket in engagement with said drive chain member and operable to longitudinally move said boom structure forwardly and rearwardly through said guide means;

(g) a hydraulic ram extending between and connected to said guide means and said platform for swinging said boom structure upwardly and downwardly;

(h) a bucket member swingably mounted to the forward end of said boom structure and a bucket cover member mounted to the bottom wall of said boom structure adjacent said forward end, said bucket member having a generally planar bottom portion and an open top for scooping material therein whereby said bucket member is rotatable forwardly to excavate and scoop material thereinto and rotatable rearwardly against said cover member to close said bucket member;

(i) a hydraulic ram and a pivotal linkage structure extending between and mounted to said boom structure and said bucket member and operable to swing said bucket member forwardly and rearwardly; and (j) control means and an operator's area upon said platform and rotatable therewith, said control means including valve members for operating said platform, boom structure, and bucket member.

2. An excavating apparatus comprising:

(a) a mobile chassis;

(b) a platform supported by said chassis in overlying relation thereto and having means rotatably mounting said platform to said chassis;

(c) a standard mounted upon said platform and extending upwardly therefrom;

(d) an elongate, rigid boom structure and guide means mounting said boom structure to said standard for upward and downward swinging movement and forward and rearward longitudinal reciprocal movement relative to said platform;

(e) a material engaging member mounted to said boom structure;

(f) motive means operable to effect rotation of said platform and movement of said boom structure;

(g) control means for controlling operation of said platform, boom structure and material engaging member whereby said platform is rotatable to position said boom structure and said material engaging member generally over material, said boom structure is swingable downwardly for contact of said material engaging member with said material and said boom structure is movable substantially longitudinally rearwardly to remove said material;

(h) said boom structure comprising an elongate beam member having respective forward and rearward ends and top and bottom walls;

(i) said guide means including a bracket member having spaced side walls and a plurality of support portions extending therebetween for receipt of said boom structure;

(j) said motive means including a hydraulic motor mounted to said bracket member and having a member engaging said beam member whereby powered rotation of said member causes said beam member to move longitudinally through said bracket member.

3. The excavating apparatus set forth in claim 2, wherein:

(a) said beam member has a drive chain member connected thereto and generally extending between said forward and rearward ends along said top wall;

(b) said bracket member support portions include roller members extending between said side portions and operable to engage said top and bottom walls; and (c) said member is a drive sprocket engaged with said drive chain for reciprocably moving said beam member through said bracket member.

4. An excavating apparatus comprising:

(a) a mobile chassis;

(b) a platform supported by said chassis in overlying relation thereto and having means rotatably mounting said platform to said chassis;

(c) a standard mounted upon said platform and extending upwardly therefrom;

(d) an elongate, rigid boom structure and guide means mounting said boom structure to said standard for upward and downward swinging movement and forward and rearward longitudinal reciprocal movement relative to said platform;

(e) a material engaging member mounted to said boom structure;

(f) motive means operable to effect rotation of said platform and movement of said boom structure;

(g) control means for controlling operation of said platform, boom structure and material engaging member whereby said platform is rotatable to position said boom structure and said material engaging member generally over material, said boom structure is swingable downwardly for contact of said material engaging member with said material and said boom structure is movable substantially longitudinally rearwardly to remove said material;

(h) said mobile chassis including spaced frame members having wheels attached thereto and a tongue structure extending from said frame members for attachment to and towing by a vehicle;

(i) said means rotatably mounting said platform to said chassis including an axial member extending between and connected to said platform and said chassis and providing relative rotation of said platform;

(j) said motive means effecting rotation of said platform relative to said chassis and including a hydraulic motor driving a first sprocket, a second and larger sprocket nonrotatably mounted to said chassis, and an endless drive chain member connecting said first and second sprockets.

* * * * *